United States Patent [19]

Snyder

[11] 3,954,165

[45] May 4, 1976

[54] AUTOMATIC COLLATING MACHINE

[75] Inventor: Clarence A. Snyder, Northbrook, Ill.

[73] Assignee: R. C. H. Tool Corporation, Morton Grove, Ill.

[22] Filed: Aug. 5, 1974

[21] Appl. No.: 494,763

Related U.S. Application Data

[63] Continuation-in-part of Ser. No. 379,003, July 12, 1973.

[52] U.S. Cl. ..... 198/34; 53/61; 53/152; 53/159; 53/164

[51] Int. Cl.[2] ..... B65G 47/26

[58] Field of Search .....198/34; 53/152, 153, 53/150, 164, 61

[56] References Cited

UNITED STATES PATENTS

| | | | |
|---|---|---|---|
| 1,821,111 | 9/1931 | Mudd | 53/61 |
| 1,839,925 | 1/1932 | McKaig | 53/164 |
| 1,950,370 | 3/1934 | Mudd | 53/164 |
| 3,513,623 | 5/1970 | Pearson | 53/159 |
| 3,530,644 | 9/1970 | Kapare | 53/152 |

*Primary Examiner*—James B. Marbert
*Attorney, Agent, or Firm*—Wegner, Stellman, McCord, Wiles & Wood

[57] ABSTRACT

An automatic collating machine for organizing into groups a flow of articles, such as ice cream sandwiches, fed to the machine to be packaged into containers includes a carrier feed station and a container loading station, both of which are located along a vertical path of movement of a plurality of equally spaced, elongate, flexible carriers that are moved around a loop including said path in a stepwise fashion. The articles fed to the machine are received at the carrier feed station where a preselected number of the articles are loaded onto an empty carrier thereat. Each time a carrier is loaded, the loop of carriers is incrementally advanced to move the loaded carriers toward the container loading station and to move the next empty carrier to the carrier feed station to repeat the carrier loading cycle. When a preselected number of loaded carriers is in position at the container loading station, the group of articles thereon is pushed off the preselected group of carriers through a suitable guide into a container such as a carton. In one embodiment, the articles are loaded seriatim onto the ends of the carriers at the carrier feed station. In another embodiment, the carrier feed station includes an accumulating table located alongside the carriers from which a preselected number of accumulated articles are simultaneously moved onto the side of the empty carrier, away from the end of the carrier.

13 Claims, 12 Drawing Figures

FIG. 3
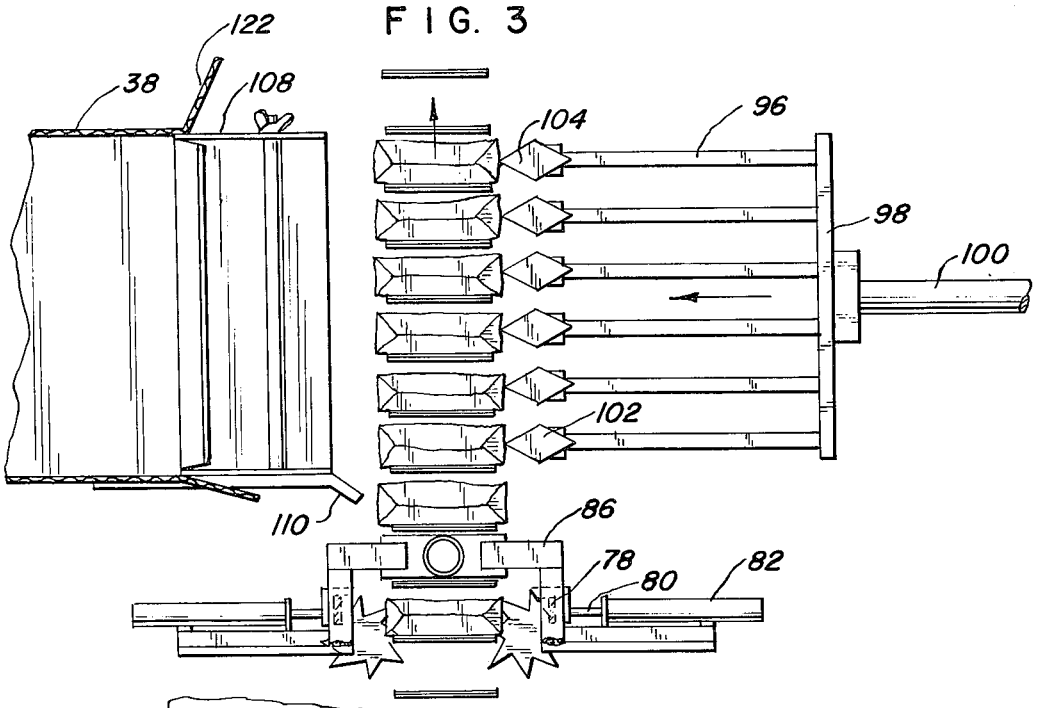
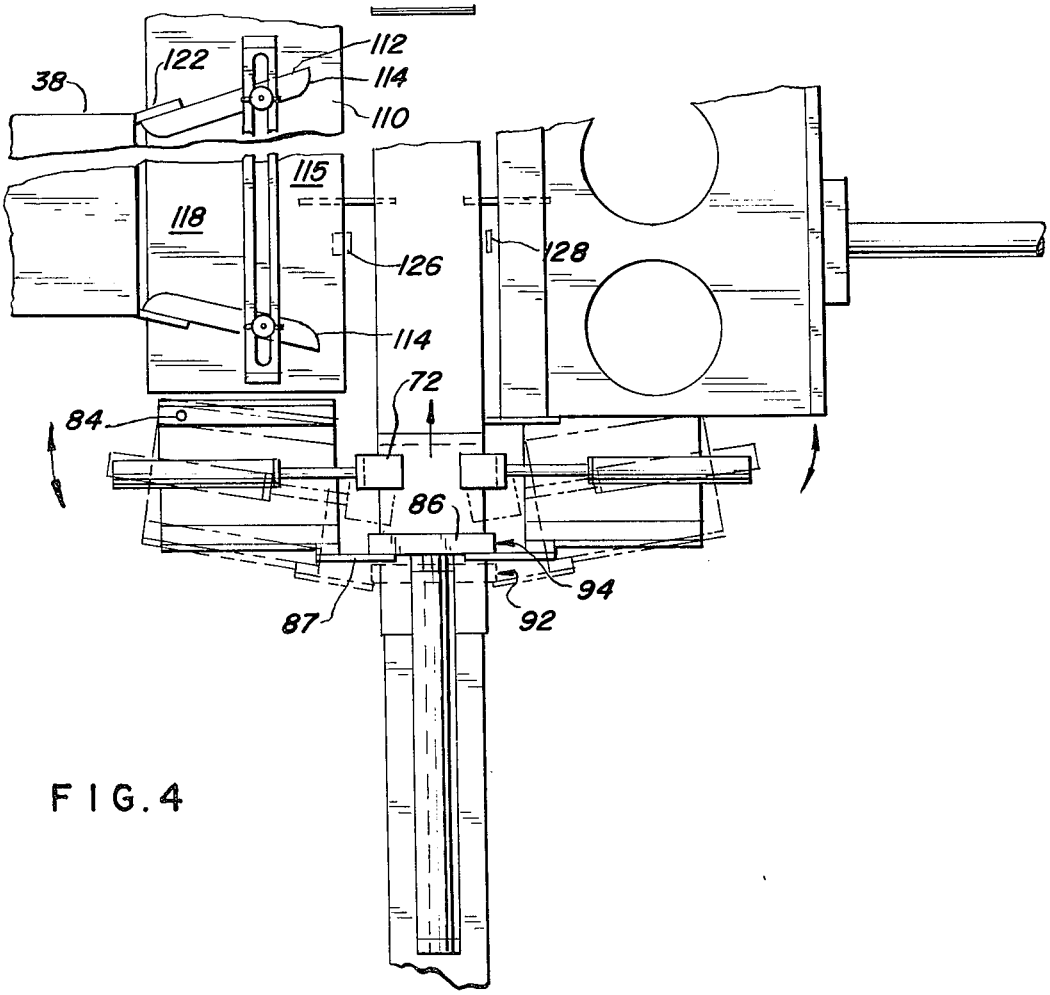
FIG. 4

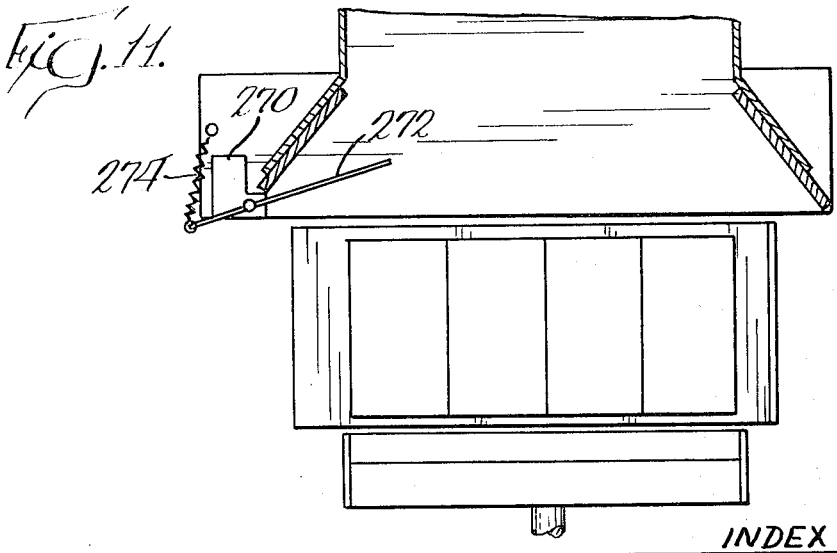
FIG. 11.
270
272
274

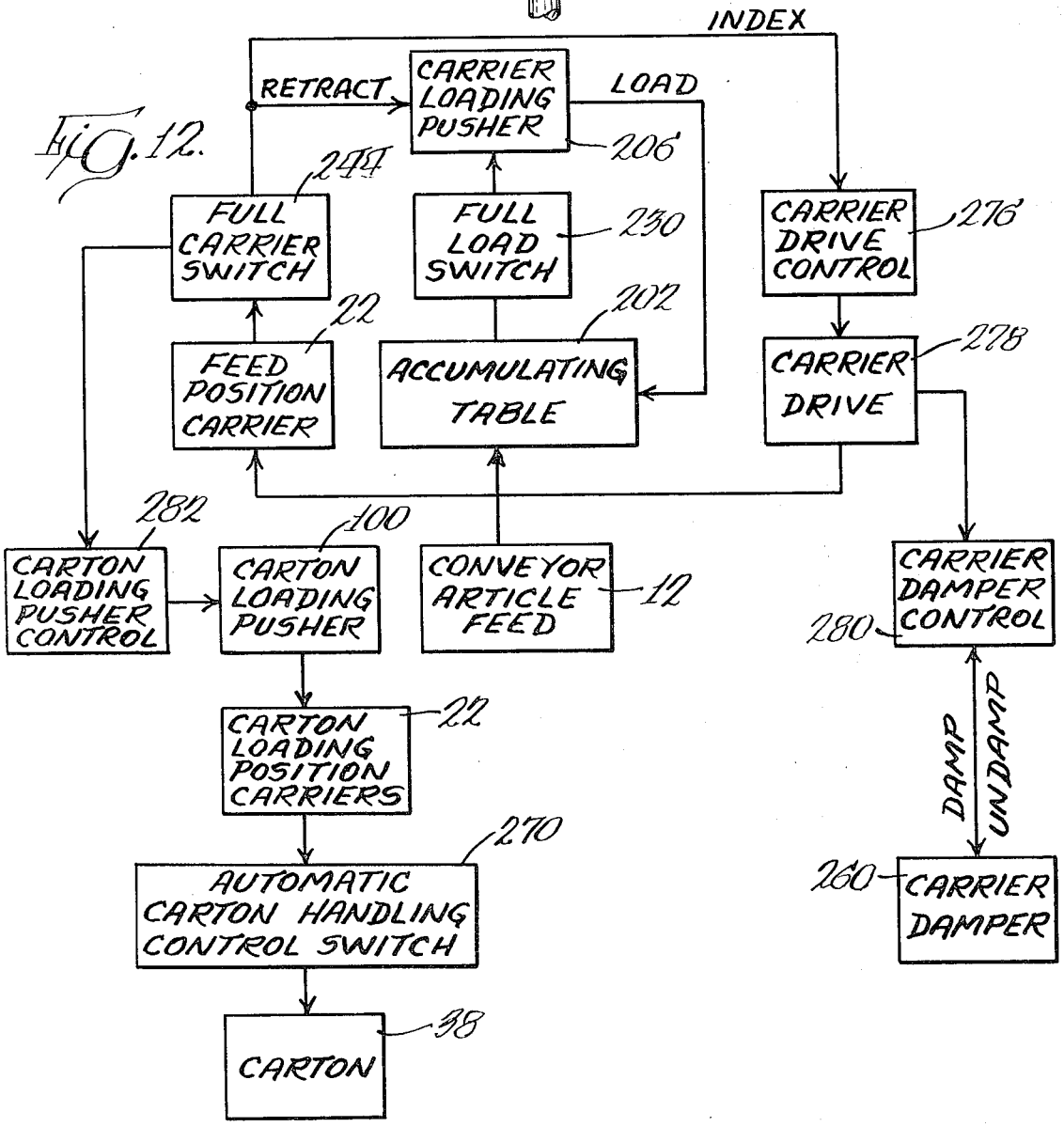
FIG. 12.
INDEX
RETRACT
CARRIER LOADING PUSHER
LOAD
206
244
FULL CARRIER SWITCH
FULL LOAD SWITCH
230
CARRIER DRIVE CONTROL
276
22
FEED POSITION CARRIER
202
ACCUMULATING TABLE
CARRIER DRIVE
278
282
CARTON LOADING PUSHER CONTROL
100
CARTON LOADING PUSHER
CONVEYOR ARTICLE FEED
12
CARRIER DAMPER CONTROL
280
CARTON LOADING POSITION CARRIERS
22
DAMP
UNDAMP
270
AUTOMATIC CARTON HANDLING CONTROL SWITCH
260
CARRIER DAMPER
38
CARTON

AUTOMATIC COLLATING MACHINE

CROSS-REFERENCE

This application is a continuation-in-part of my copending application Ser. No. 379,003, filed July 12, 1973, entitled "Automatic Packaging Machine."

BACKGROUND OF THE INVENTION

This invention relates to an automatic collating machine, and more particularly, to a machine for automatically organizing a flow of articles continuously fed to the machine into groups to be packaged into containers.

Numerous machines have been designed for automatically packaging a plurality of articles into individual containers which illustrate sundry methods of receiving the articles to be packaged, accumulating the articles, and arranging them into selected groups, such as rows, and moving the articles from place to place where each of the foregoing operations can be performed. Without detracting from the utility of known packaging or collating machines, it is observed that many, if not all of them, lack the versatility frequently required by the users of such machines, and due to the selected relative locations and imparted direction of article movement of the various article handling stations in such machines, they are often unduly complicated.

The various problem areas of known machines are too numerous to discuss here, but an exemplary illustration of some of the limitations and undue complications in particular machines can be had by an examination of U.S. Pat. No. 3,655,180 2,633,280 and 1,803,123. The general problem is of course to provide a simple, efficient, fast, inexpensive and versatile machine for automatically performing the above operations to achieve the desired packaging result.

SUMMARY OF THE INVENTION

It is thus the principle object of the present invention to provide an automatic collating machine which performs the aforementioned operations in a unique and efficient manner while overcoming many of the limitations and disadvantages of known machines. Briefly, the machine accumulates and arranges the articles into groups of rows and columns defining a layer of articles which may then be inserted into suitable containers, such as cardboard or pasteboard cartons, or the like, a layer at a time.

More specifically, the automatic collating machine is adapted to be fed by, or may include as part of the machine, a continuously driven conveyor on which the articles to be packaged are deposited and moved thereby to a carrier feed station at a first transfer point where they are received and pushed across a substantially horizontal planar surface thereof in an end-to-end abutment from a receiving end to an opposite end thereof by the force of successive articles being pushed onto the planar surface at the receiving end by the continuously driven conveyor. A selected number of articles is moved onto a movable wicket or carrier positioned thereat, and after the carrier has been loaded with the selected number of articles, a carrier drive mechanism is actuated. Actuation of the carrier drive mechanism results in the loaded carrier being moved up an incremental distance along the loop path about which the carriers are moved and an empty carrier being moved to the feed position to be loaded, and the cycle is successively repeated. At the container loading station, all of the articles on a preselected group of loaded carriers positioned thereat are pushed off the side of the carriers across a plate and through an adjustable guide into a suitable container.

An important feature of the invention is the provision of means for preselecting the number of articles to be loaded onto each carrier. In one embodiment in which the articles are loaded seriatim onto each carrier from the end of the carrier and moved thereacross in end-to-end abutment along the carrier length, means for adjusting the position of a photocell designed to detect the presence of the first article loaded onto the carrier provides the means for preselecting the number of articles. In a second embodiment, in which the carrier feed station includes an accumulating table off which articles are simultaneously pushed onto the carrier from the side of the carrier, the means for preselecting the number of articles is provided by means for adjusting the dimensions of an article pusher and the location of a shearing surface.

A further feature found in both embodiments of the automatic collating machine of the present invention is that the carriers are flexible and pushers provided at the carton loading station are provided with camming surfaces at their respective article engaging ends which will move a carrier out of the path of pusher movement in the event of engagement therewith and thereby avoid damage to the machine.

Another feature of the present invention is that all of the stations at which the various operations are performed are located along a vertical run of the carrier loop such that the loaded carriers are always horizontally disposed, thereby eliminating the necessity of providing special article retention means on the carrier to prevent them from falling off, which might otherwise occur if the loaded carriers were other than horizontally disposed.

A further feature of the automatic collating machine is that the articles are moved across the carrier feed station by the force of successive articles being fed into the feed station by the conveyor, thus eliminating the need for a separate drive mechanism for the carrier feed station. Further, this method of moving the articles across the carrier feed station inherently arranges the articles in desired end-to-end abutting relationship.

Yet another feature of the automatic collating machine of the present invention is the provision of a bridge over which the articles may pass between the carrier feed station and the carrier thereat. In the first embodiment, the bridge comprises a plate mounted for pivotal movement so as not to interfere with carrier movement, and in the second embodiment the bridge is designed to be flexible for the same reason. An important advantage of the bridge is that it facilitates smooth transfer of the articles despite inadvertent misalignment between the carrier and the carrier feed station.

Still a further feature of the automatic collating machine of the present invention is the provision of a guide at the carrier feed station with a top plate that adjusts vertically to prevent the stacking of oncoming articles on top of one another when there is a pause in article movement across the carrier feed station during the carrier loading cycle.

A desirable feature of the automatic collating machine of the present invention is the provision of a container handling control switch which is mounted on the container guide and activated by the layer of articles being pushed through the guide to provide an indication to an automatic carton handling machine or the like.

A significant advantage of the second embodiment of the present invention over known automatic packaging machines and even over the first embodiment of the present invention is that because the articles are first accumulated seriatim and then loaded onto the carrier from the sides of the carrier rather than from the end of the carrier, carrier loading and article positioning are substantially simplified, and versatility of the machine in regard to selection of the number of articles per carrier is substantially enhanced.

DESCRIPTION OF THE DRAWINGS

The foregoing features and advantages will be made more apparent and further features and advantages will be discussed in the following description of the preferred embodiments of the automatic collating machine taken together with the following drawings, in which:

FIG. 3 is an end view of a vertical section taken through the carrier feed station of FIG. 1 illustrating the relative vertical location of the feed, stacking and container loading stations;

FIG. 4 is a top view of a portion of the first embodiment of the collating machine illustrating the retaining means;

FIG. 11 is a view of a horizontal section taken through a portion of the container loading station illustrating the container handling control switch mounted on the guide as well as a pusher arm adjacent the group of articles on a loaded carrier; and FIG. 12 is a block diagram of the control system for the second embodiment of the automatic collating machine.

DESCRIPTION OF THE PREFERRED EMBODIMENT

The automatic collating machine of the present invention is particularly adapted for packaging ice cream sandwiches comprising soft, only partially frozen ice cream sandwiched between two cookie-type wafers. Due to the soft nature of the ice cream at the time of packaging, the sandwiches must be delicately handled by the machine to prevent damage to the sandwiches which would interfere with the smooth running operation of the machine. The machine is, however, of course suitable for packaging many other types of articles.

Figure 1:
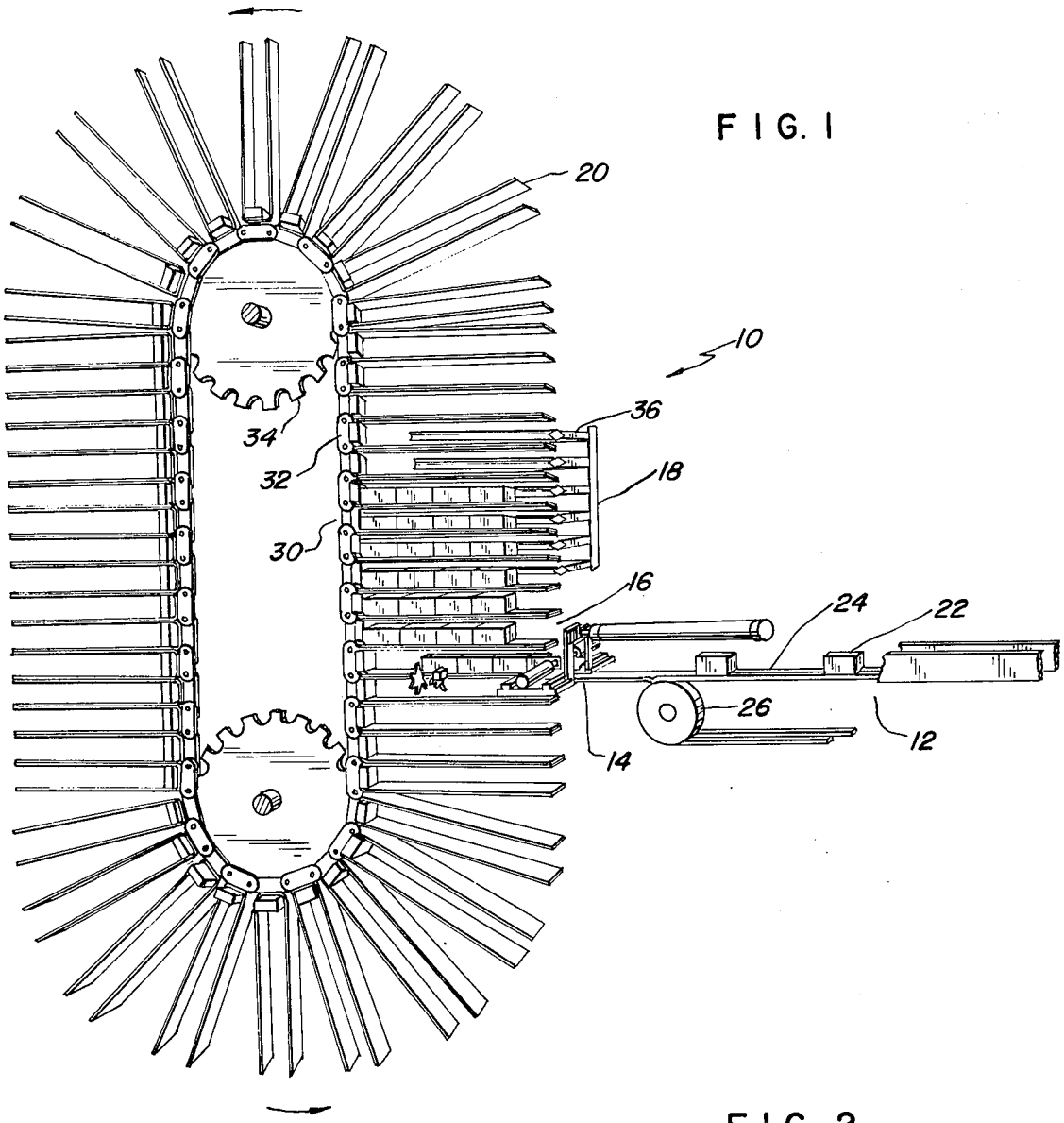
FIG. 1 is a perspective view of a first embodiment of the automatic collating machine with supporting structures omitted for purposes of clarity.
Figure 5:
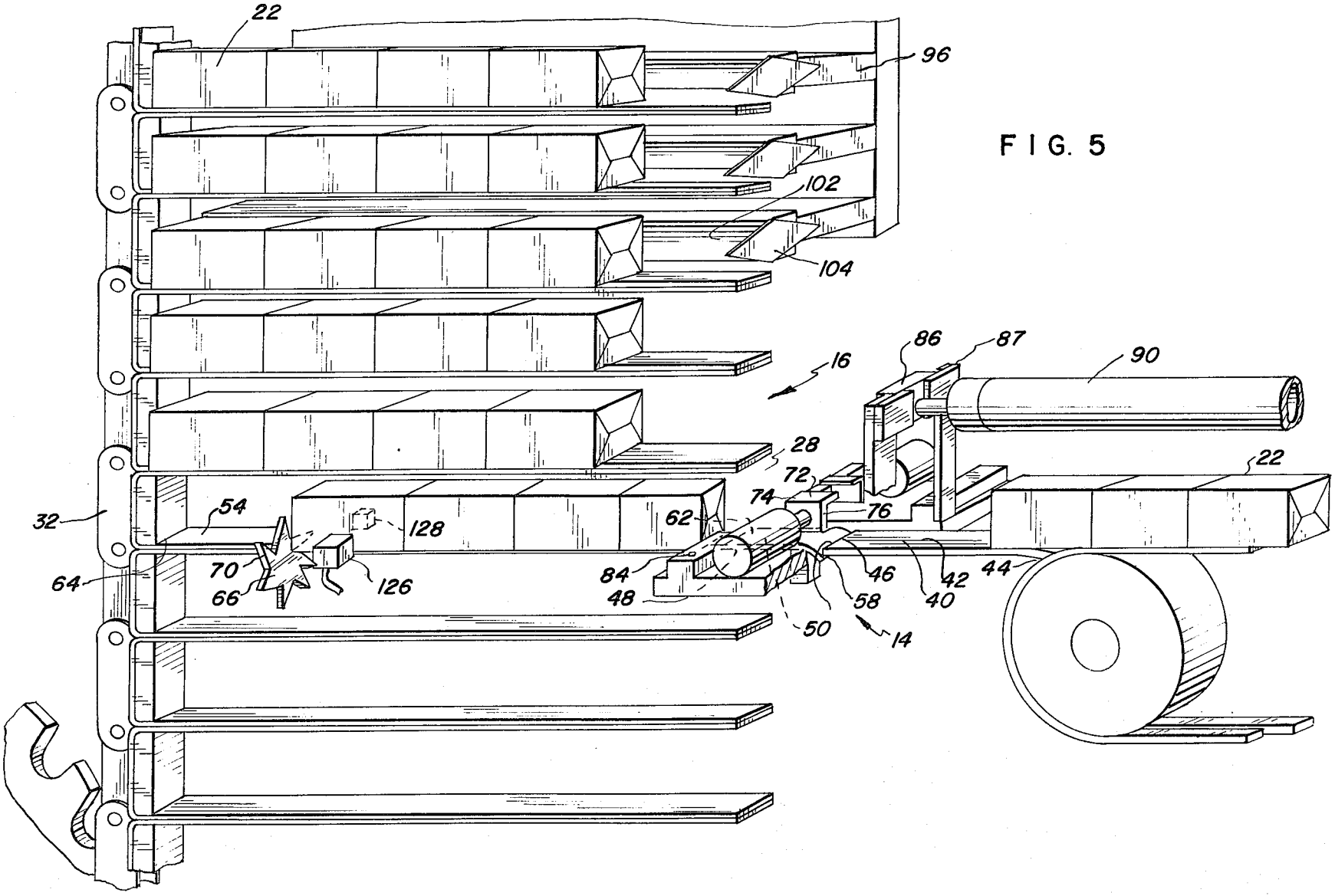
FIG. 5 is a perspective view of a portion of the first embodiment of the automatic collating machine of the present invention illustrating the carrier feed station, the stacking station and the loading station.

Referring now to the drawings, particularly FIGS. 1 and 5, a first embodiment of the automatic collating machine generally designated by reference numeral 10 is seen to comprise, briefly, a continuously driven conveyor 12, a carrier feed station 14, an article positioning station 16, a container loading station 18, and a plurality of carriers 20.

The articles 22 to be packaged are deposited on conveyor belts 24 of the conveyor 12 which is continuously driven by a suitable conveyor drum 26 to move articles 22 to carrier feed station 14. The articles from the conveyor are fed to carrier feed station 14 which, in turn, feeds the articles onto one of the carriers 20 located at a feed position 28 adjacent carrier feed station 14. After a preselected number of articles has been loaded onto the carrier at the feed position, all of the carriers 20 including the one just loaded are moved an incremental distance corresponding to the spacing between carriers by carrier drive means generally designated by reference numeral 30 which may comprise a chain 32 to which the carriers 20 are mounted on the outer periphery thereof and which defines a carrier loop path about which the carriers are moved. The chain, in turn, is intermittently driven by sprockets 34, one of which is suitably linked with a carrier motor, not shown.

The loaded carrier 20 is moved upwardly one step to article positioning station 16 and the empty carrier immediately preceding it in the loop is moved to the carrier feed position and, in turn, is loaded with articles fed from feed station 14. At article positioning station 16, the articles on the loaded carrier are repositioned thereon to facilitate subsequent removal at container loading station 18 to which the carrier is next moved. When all of the carriers positioned adjacent the container loading station are loaded with articles, a container loading pusher 36 is actuated to push all of the articles thereon into a suitable container 38 located oppositely from loading pusher 36 on the other side of the carriers 20 thereat, as best seen in FIG. 3.

Referring to FIG. 5, the feed station 14 includes a fixed plate 40 having a horizontally disposed planar surface 42 between a receiving end 44 adjacent the ejecting end 45 of the conveyor belts 24 and an ejecting end 46. Bridging the gap between ejection end 46 of fixed plate 40 and a receiving end 48 of one of the carriers 20 at the feed position is a pivotal plate or bridge 50 having a planar surface 52 substantially coplanar with planar surface 42 and the lower carrying plate 54 of the carrier at the feed position. Pivotal plate 50 is mounted for pivotal motion about an axis 56 but has a downturned portion 58 at its receiving end 60 which underlies the fixed plate 40 at its ejection end 46, such that it is prevented from pivoting in other than a clockwise direction from the position shown as viewed in FIG. 5. Spaced from receiving end 60 is an ejection end 62 overlying a portion of carrier plate 54 at its receiving end 48. Pivotal plate 50 provides a bridge between the end of fixed plate 40 and the carrier 20 at the feed position, and the pivotal mounting therefor permits the carrier to be raised to the next position after it is loaded. When the carrier at the feed position is raised to the next position along the carrier loop, the upward force of the carrier acting on the overlying portion of the pivotal plate 50 at its ejection end 62 pivots pivotal plate 50 to raise ejection end 62 with respect to receiving end 60 out of the path of carrier movement. After the pivotal plate has been pivoted sufficiently so that it no longer overlies the carrier, it falls back to the position shown in FIG. 5.

The surfaces of the upper run of conveyor belts 45, fixed plate 40, pivotal plate 50 and carrier surface 54 at the feed position are all substantially horizontally disposed and coplanar with one another. The articles 22 are moved across the fixed plate 40 onto and across pivotal plate or bridge 50, and onto and across the carrier at the feed position, in end-to-end abutment by the force of successive articles 22 being pushed onto fixed plate 40 at its receiving end 44. The first article pushed onto fixed plate 40 is pushed forward to the carrier by the second article, both the first and second articles are further pushed by the third article, and then so on, such that the articles move across the plates of the feed station and the carrier in end-to-end abutment which, of course, is the relationship desired. Thus, a separate mechanism is not required to move the articles from the conveyor onto and across the carrier.

Adjacent the sides of the carrier at the feed position between its receiving end 28 and its other end 64 are a pair of star wheels 66, one on each side of the carrier and in alignment with one another providing an alignment surface for the first article 22 fed onto the carrier should it become askew. Star wheels 66 are rotatably mounted to rotate with about an axis 68 and have a plurality of equally spaced arms 70 which extend outwardly away from axis 68. One of the arms 70 of each star wheel extends across at least a portion of the carrier at the feed position toward the other star wheel in a direction transverse to the direction in which the articles are moved across the carrier. The rotatable mounting of the star wheels permits upward motion of the carrier after it is loaded, for the arm of each star wheel extending across the loaded carrier is pivoted out of the path of the carrier when it is moved upward. The arms are successively engaged by the empty carriers as they are moved to the feed position and moved thereby into aligning position. The star wheels 66 may also be movably mounted so that they may be positioned at different points along the length of the carrier to permit the loading of a greater or lesser number of articles on each carrier.

In order to prevent the article immediately successive to the last article to be loaded on the carrier, i.e., the first article to be fed onto the next empty carrier, from interfering with the upward motion of the carrier during indexing thereof or from being ejected off the ejection end of the pivotal plate prior to presentation at the feed position of the next empty carrier, a pair of retaining fingers 72 is provided adjacent the pivotal plate to retain or hold therebetween the next to the last article until an empty carrier is moved to the feed position. The retaining fingers 72 are located on either side of the pivotal plate and are aligned over the pivotal axis thereof so as not to interfere with its pivotal motions and are adapted to move toward each other to close onto the sides of the article thereat, holding it on the pivotal plate. Each of fingers 72 is L-shaped, having a top portion 74 which overlies the article being held and a vertically disposed side portion 76 which engages the article. If the articles being packaged are ice cream sandwiches, the actual surface of the side portion 76 which contacts the article may be covered with a suitable cushion material 78 to prevent damage to the sandwich, as best seen in FIG. 3. Each of the fingers is secured to a suitable drive means such as to the end of a piston member 80 of a suitable pneumatic cylinder 82 which provides the drive for the finger motion.

Each of the retaining fingers 72 is mounted for pivotal motion about a vertically oriented pivotal axis 84 and has a arm 86 which extends upward to the article positioning station 16 and is engageable by a pusher member 86 thereat to pivot the fingers 72 and article held thereby away from the path of carrier movement. Article positioning station 16 comprises the pusher member 86 secured to the end of a piston 88 of another pneumatic cylinder 90 which provides the drive for reciprocal motion of the piston and thus pusher member 86. When actuated, the pusher member at the end of piston 88 is driven outward from cylinder 90 and pushes the articles on the carrier at the positioning station to a preselected position on the carrier, such as the position shown in FIG. 5 in which the first article is in abutment with the base end 64 of the carrier. When the pusher member 86 is retracted toward cylinder 90, it engages arm 86 and continues to a position 92 indicated in broken lines in FIG. 4, causing fingers 72 and the articles held thereby to be pivoted toward the receiving end of the pivotal plate and away from and out of the path of carrier movement. After the carriers have been indexed, each of fingers 72 is retracted toward its pneumatic cylinder 82, releasing hold of the article, and the pusher member 86 is moved to a position 94 illustrated in solid lines in FIG. 4, permitting the fingers 72 to return to their unpivoted position.

After the carrier has been loaded and the articles thereon repositioned, it is moved upward to the container loading station, best illustrated in FIG. 3. The container loading station comprises a plurality of horizontally disposed loading pushers 96 mounted at one end to a loading support member 98 which in turn is secured to the end of a reciprocating piston driven by a pneumatic cylinder, not shown. The loading pushers 96 have an article engaging edge 99 of sufficient length to engage all of the articles on the carrier, and are appropriately spaced so that each is in alignment with one of the carriers at the container loading station. If the articles being packaged comprise ice cream sandwiches, the article engaging edge 99 may have a concave surface 102 such that the article is contacted only at the wafer portions of the sandwich rather than the soft ice cream sandwiched therebetween to thereby prevent distortion of the soft ice cream by the pushing action. Further, at either end of each of the loading pushers 96 may be located a suitable cam surface 104 extending beyond edge 99 to cam the flexible carrier plate out of the path of the article engaging edge 99 to prevent the loading pusher members 96 from pushing against the edges of the carrier in the event the carrier and pusher inadvertently become misaligned.

The pusher members 96 are in alignment with and located on one side of a preselected number of carriers, and located opposite from the pusher members 96 on the other side of the carriers is located a guide 108 comprising a bottom, horizontally disposed, support plate 110 and two pivotal guide plates 112 normal to base support 110 and oriented such that the distance between their forward edges 114, defining a receiving opening 115, is enlarged with respect to the distance between their rearward edges 116, defining an ejection opening 118. The container 38 is held with its open end telescoped over ejection opening 118 with its flaps 122 overlying the outer surfaces of plates 112. During each loading operation, the loading pushers 96 are moved toward the guide 108, pushing all of the articles on the loaded carriers thereat across support plate 110, through guide 108, and into container 118.

The fact that the carrier at the feed position has been loaded with the preselected number of articles is detected by a reflective photocell circuit having a combination photocell light source 126 located on one side of the carrier at the feed position and a reflector 128 on the other side of the carrier opposite from and in alignment with the photocell 126. The photocell and reflector are located adjacent the star wheel between the star wheel and the receiving end of the carrier in a position where the first article received on the carrier will be interposed therebetween when the last article to be received is fed onto the carrier at its receiving end.

Figure 2:
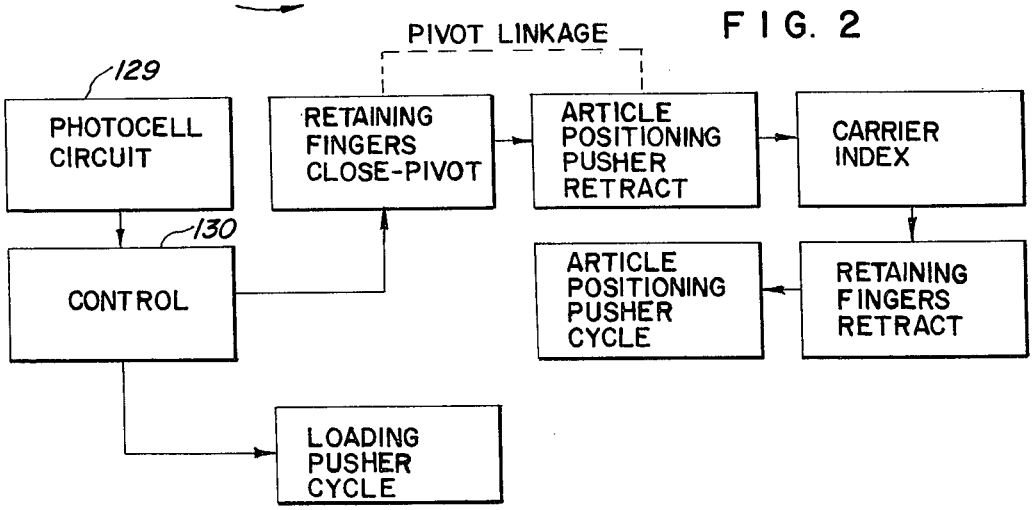
FIG. 2 is a block diagram illustrating the sequence in which the various driven mechanisms of the machine of FIG. 1 are controlled.

Referring to FIG. 2, the sequence of operations is initiated when the photocell circuit 129 detects the presence of an article and generates a signal to a suitable control circuit 130 which actuates the retaining fingers 72 to close toward each other to hold the article which is next to the last article received by the carrier on the fixed plate away from the path of carrier movement. The article positioning pusher 86 is then retracted to its position 93 engaging arms 86 to pivot the fingers and the article held thereby away from the ejection end of the pivotal plate. Next, the drive for the carrier conveyor is actuated to advance the carriers an incremental step around the carrier loop to move the loaded carrier to the positioning station and an empty carrier to the feed position. The retaining fingers are then actuated to move to their retracted position, releasing the article, and loading of the empty carrier commences. During the loading of the carrier, the article positioning pusher is actuated to push the articles on the carrier thereat to the preselected position and then retracts to its position 94.

The foregoing cycle, of course, is repeated each time the photocell circuit detects the presence of an article. After the foregoing cycle has been repeated in succession a preselected number of times equal to the number of rows or loading station positions, indicating that all of the carriers at the loading station positions are loaded, the control actuates the loading pushers to push the articles off the carriers thereat into the container and then retract to their position as shown in FIG. 3.

In accordance with the invention, the packaging machine is adaptable to arrange the articles in any number of rows and columns. By varying the position of the photocell, the number of articles to be loaded on the carrier can be varied and by varying the number of loading pushers 96 and the number of carrier loading cycles which must be repeated before the loading carrier is actuated, the number of carriers which is unloaded may be varied.

Figure 6:
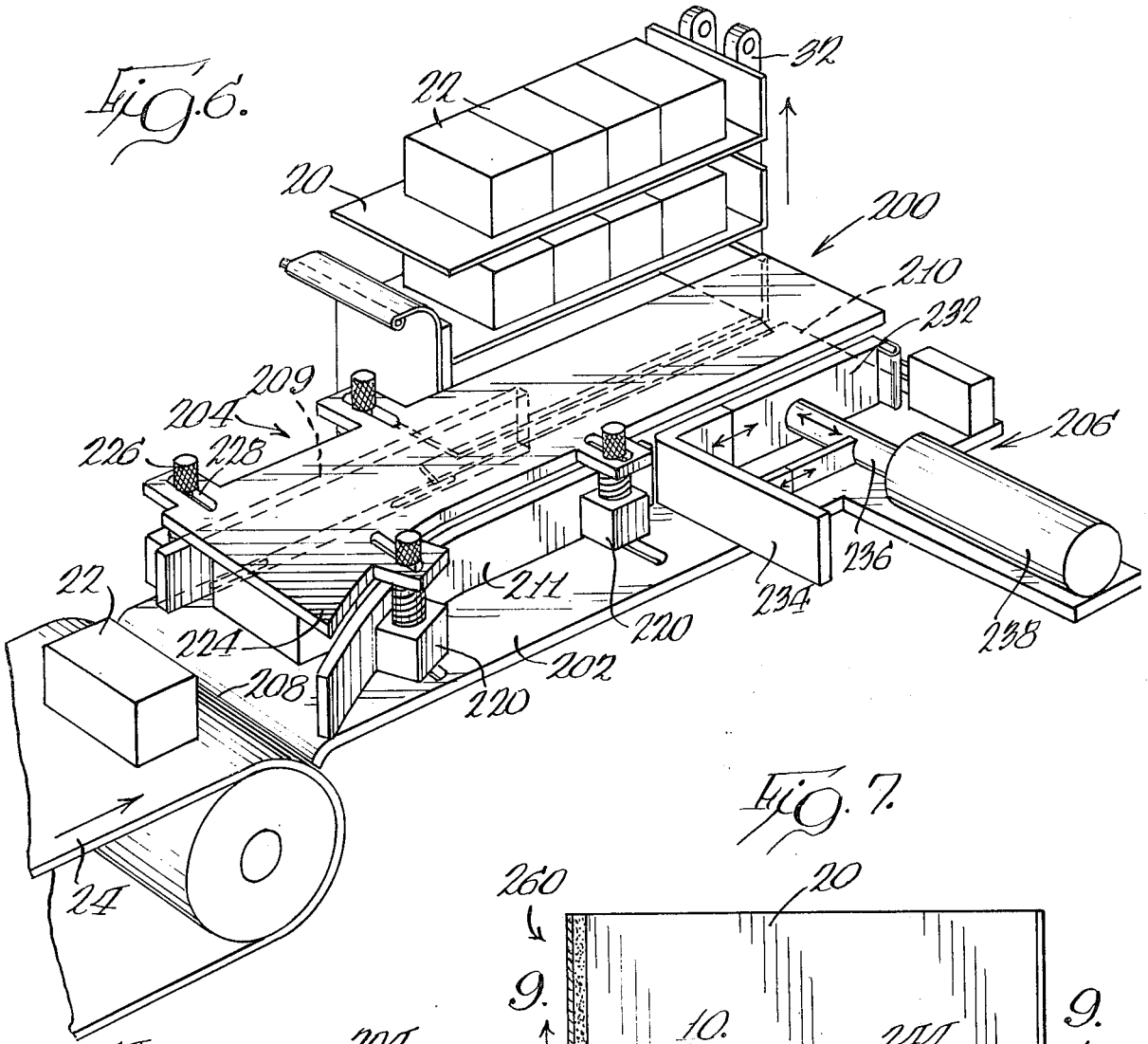
FIG. 6 is a perspective view of a portion of a second embodiment of the automatic collating machine of the present invention illustrating the accumulating table at the carrier feed station, the adjustable guide and the adjustable pusher member on the accumulating table provided for preselecting the number of articles per carrier.

A second embodiment of the automatic collating machine of the present invention is illustrated in FIGS. 6–12 with the features illustrated in FIGS. 8, 9, 10 and 11 suitable for use with the first embodiment as well as the second embodiment of the automatic collating machine. As best seen in FIG. 6, the principle difference between the second embodiment and the first embodiment is that in the second embodiment the carrier feed station 14 is located alongside carriers 20, at which location a preselected number of accumulated articles is simultaneously pushed onto the side of the carrier, whereas in the first embodiment of the automatic collating machine, the articles are fed seriatim onto the end of the carrier at the carrier feed station. Because of this relocation of the carrier feed station, the retaining fingers 72, the article positioning stations 16 and associated mechanisms and controls therefor and are not needed and thus eliminated in the second embodiment. Further, preselection of the number of articles to be loaded onto each carrier, provided by photocells 126 and 128 and associated controls in the first embodiment, is provided for in a mechanical fashion in the second embodiment. While the relocation of the carrier feed station does eliminate the foregoing elements, the accumulation of articles at the carrier feed station does necessitate the addition of a pusher mechanism for transporting the preselected number of articles onto the carrier. It should be appreciated that only those portions of the second embodiment of the automatic collating machine of the present invention which are different with respect to the first embodiment, as illustrated in FIGS. 1–5, are shown in FIGS. 6–12. Thus, while not shown in FIGS. 6–12, the second embodiment of the automatic collating machine is provided with a continuous loop of carriers 20 driven by a carrier drive means 30 and a container loading station 18 substantially identical to those shown in FIG. 1.

Carrier feed station 200 is adapted to receive articles 22 continuously fed thereto by conveyor belt 24, accumulate and arrange the received articles, and then, at an appropriate time, push a preselected number of the accumulated articles less than the total number accumulated onto an empty carrier at the carrier feed station. Briefly, the accumulating function is performed by an accumulating table 202; the article arrangement function is performed by an adjustable guide generally designated by reference numeral 204; the loading action is provided by a carton loading pusher mechanism 206 and preselection of the number of accumulated articles to be loaded onto the carrier is provided by means for adjusting the location of the guide mechanism 204 and means for adjusting the dimension of the article engaging portion of the carrier pusher mechanism 206.

Figure 7:
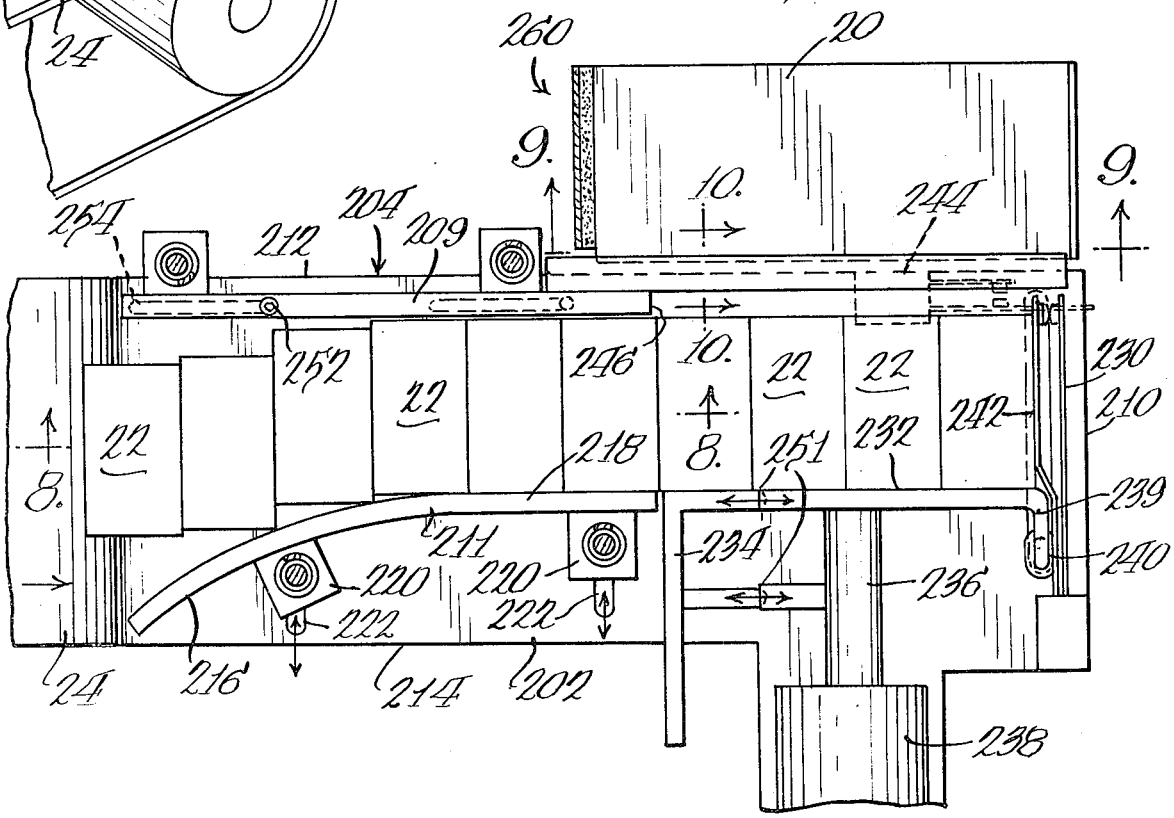
FIG. 7 is a top view of the accumulating table and a carrier at the first transfer point, illustrating the location of control switches relative to the accumulating table in the machine of FIG. 6.

During operation of the machine, articles 22 are fed onto a receiving end 208 of accumulating table 202 and are moved across the horizontal surface thereof toward the opposite end 210 of the table. As best seen in FIG. 7, the articles are pushed across accummulating table 202 by the force of successive articles being pushed onto the receiving end of the table and thus move across the table in an end-to-end abutting relationship in the same fashion that articles are moved across fixed plate 40 of the carrier feed station of the first embodiment.

The continuous feeding of articles 22 onto accumulating table 202 advantageously inherently arranges them in end-to-end abutment. However, the articles may be deposited on the conveyor such that they are out of alignment along a direction transverse to the direction of conveyor movement, and, partly for this reason, a guide mechanism 204 is provided. Guide mechanism 204 comprises a straight elongate guide plate 209 and a curved elongate guide plate 211 spaced from guide plate 209. Both guide plates 209 and 211 extend from adjacent receiving end 208 of accumulating table 202 to a point on the accumulating table intermediate the ends of, but adjacent the free end of, the carrier at the carrier feed position, and thus provide guidance for the articles up to that point. Guide plate 209 is located adjacent and parallel to the side 212 of accumulating table 202 which is adjacent the side of the carrier at the carrier feed position. Guide plate 211 on the other hand has a portion 216 which curves inwardly from adjacent the side 214 opposite side 212 of accumulating table 202 at receiving end 208 toward guide plate 209 until it merges with a straight portion 218 parallel to guide plate 209. The curved portion 216, of course, permits entry of misaligned articles onto the receiving end 208 of the accumulating table and then provides a bearing force to gradually align the articles as they proceed toward the opposite end 210 of the accumulating table. Upon reaching the straight portion 218 of guide plate 211, the articles are in alignment.

To accommodate articles of various sizes, the spacing between guide plates 211 and 209 may be adjusted by securing mounting post 220 of guide plate 211 at selected positions along elongate transverse adjustment slots 222. While not shown in the drawings, it is contemplated that the guide mechanism 204 could also be advantageously utilized in conjunction with fixed plate 40 of the first embodiment shown in FIG. 5.

Figure 8:
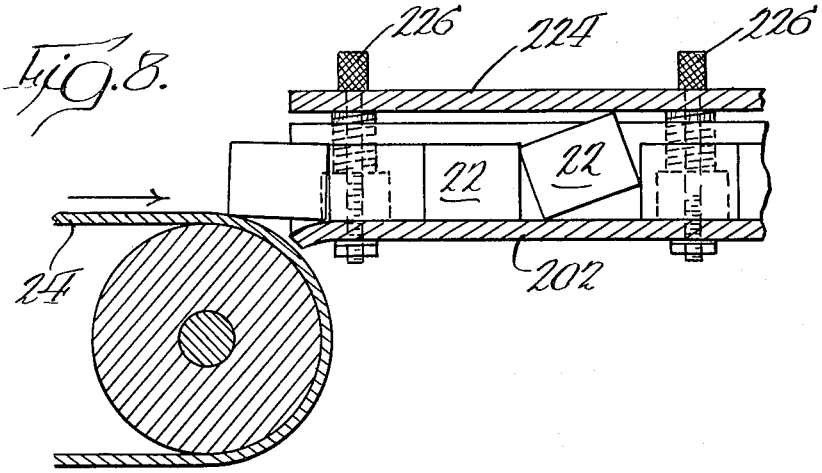
FIG. 8 is a view of a vertical section taken along section line 8—8 of FIG. 7 illustrating the manner in which the top plate of the guide maintains the articles flush with the table, in the machine of FIG. 6.

To prevent misaligment of the articles 22 in the vertical direction, guide mechanism 204 is further provided with an upper guide plate 224 as best seen in FIG. 8. As with the horizontal guide plates, accommodation for different size articles is provided by suitable adjustment nuts 226 which may be used to raise or lower upper guide plate 224 with respect to accumulating table 202. As illustrated in FIG. 8, the upper guide plate 224 prevents articles from buckling, and thereby prevents one article from stacking on top of another, which might otherwise occur when the continuous flow of articles on the accumulating table is terminated during the carrier loading cycle. Finally, with regard to upper guide plate 224, the opening in upper guide plate 224 through which the vertical bolts associated with adjustment nuts 226 extend are provided in the form of elongate slots 228 to permit lateral adjustment of curved guide plate 210.

The lead article 22, upon reaching a point adjacent end 210 of accumulating table 202, presses against and thereby actuates a full load switch 230, as best seen in FIG. 7. Actuation of full load switch 230, in turn, causes actuation of the carrier loading pusher 206. Carrier loading pusher 206 includes an elongate article engaging pusher member 232 which carries a stop member 234, both of which are secured to the end of a piston 236 of a pneumatic cylinder 238 that provides the drive for the reciprocal motion of the other members of the pusher assembly. Upon initial closure of switch 230 by a lead article 22, piston 236 is driven outwardly from pneumatic cylinder 238 and simultaneously pushes all of the articles 22 located along the length of pusher member 232 onto the carrier 20 at the carrier feed position. During the forward motion of the pusher, switch 230 is maintained in its closed position by means of a turned portion 239 of pusher member 232, which maintains pressure against the movable contact of switch 230 to keep the switch closed until the pusher member 232 is retracted into its position shown in FIG. 7. Carried at the end of end portion 239 is a downwardly extending leg 240 that rides in an elongate slot 242 extending through accumulating table 202. A full carrier switch 244 located beneath the table adjacent the side of the carrier is closed upon engagement with leg 240 when the pusher is fully extended to provide a signal to cause retraction of pusher member 232. Stop member 234 is provided to prevent movement of the articles not being loaded into the path of pusher movement.

Frictional forces exist between the sides of contiguous articles. Accordingly, end 246 of the guide plate 209 functions as a stop surface or shearing edge to prevent the frictional force of the last article of the group being loaded acting on the first article of the next group to be loaded from moving it toward the carrier.

Figure 10:
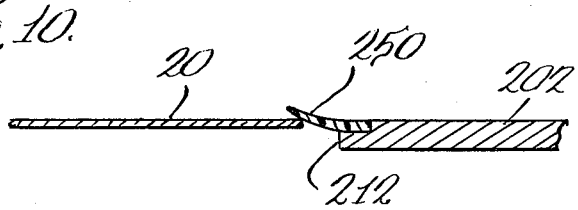
FIG. 10 is a view of a vertical section taken along section line 10—10 of FIG. 7 showing the flexible bridge attached to the accumulating machine.

As best seen in FIG. 10, a bridge 250 is provided to facilitate the transfer of articles from accumulating table 202 to the carrier 20 at the carrier feed position. Bridge 250 is secured at one end to the accumulating table 202 at its side 212 and extends therefrom to overlie a portion of the carrier. In accordance with the invention, bridge 250 is made from a suitable resilient flexible material to permit unimpeded movement of the carrier. As the carrier moves in an upward direction, the free end of the bridge 250 is bent upwardly until it slips off the edge of the carrier and returns to its original position. Although not shown, a bridge similar to bridge 250 could of course also be utilized in place of the pivotal plate 50 of the first embodiment shown in FIG. 5. The bridge ensures that an article will not be pushed against the edge of a carrier in the event of misalignment.

In accordance with the present invention, provision is made to preselect a number of accumulated articles less than the total number accumulated on accumulating table 202 to be loaded onto each carrier. Accordingly, the pusher member 232 is telescopically adjustable as shown at 251 in FIG. 7, to change the effective length of pusher member 232 and thus the number of articles to be pushed thereby. In conjunction with the telescopic adjustment feature of pusher member 232, the position of guide plate 209 may be adjusted. Specifically, guide plate 209 is secured to accumulating table 202 by means of screws 252 which extend therethrough and through elongate slots 254 within table 202. Guide plate 209 may thus be repositioned anywhere along the length of slots 254.

Figure 9:
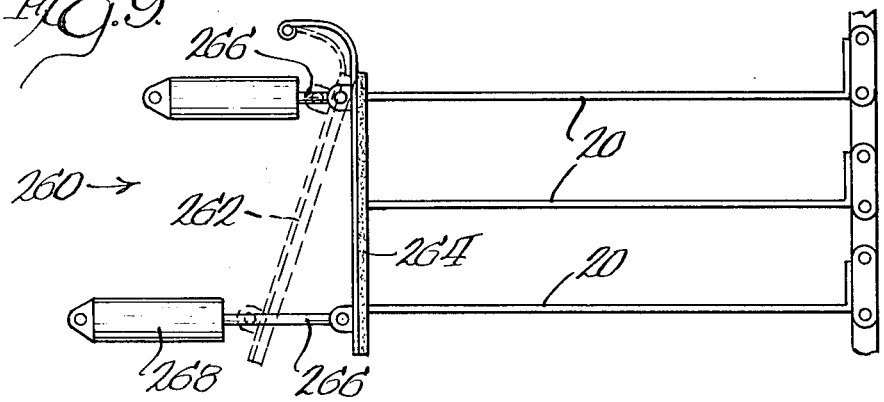
FIG. 9 is a view of a vertical section taken along section line 9—9 of FIG. 7 illustrating the damper mechanism.

As earlier indicated, the carriers 20 are designed to be resiliently flexible and camming surfaces 104 are provided at the ends of the container loading pusher to prevent damage to these parts of the machine in the event of inadvertent misalignment. However, because the carriers are flexible, undesirable oscillation may result. To prevent or limit such oscillation, a mechanical damper generally designated by reference numeral 260 may be provided. As best seen in FIG. 9, mechanical damper 260 comprises a pivotally mounted damper blade 262 having a suitable damping material 264 secured to one side thereof which is pressed against the end of the loaded carrier to dampen any oscillation thereof. After each index movement of the carriers, a pair of pistons 266 is driven outwardly from their respective associated pneumatic cylinder 268 to move the damper material 264 into contact with the carriers. After oscillations have stopped, the pistons 266 are retracted so that the damper does not interfere with carrier movement during the next incremental advancement thereof.

Finally, it is contemplated that the automatic collating machine of the present invention may be utilized in cooperation with an automatic carton handling machine. Accordingly, a carton handling control switch 270 may be provided at the carton loading station to provide an indication that a layer of articles is being loaded. Referring to FIG. 11, the carton handling control switch 270 is seen to comprise a pivotally mounted switch actuating member 272 which is mechanically biased into a position in the path of movement of the articles being loaded by means of a suitable spring 274. Upon engagement with the switch actuating member 272 by the articles being loaded, the switch will change states to provide an indication thereof.

The sequence during a single cycle of operation of the second embodiment of the automatic collating machine of the present invention can best be described with reference to FIG. 12. First, articles are fed from conveyor 12 onto accumulating table 202. The articles proceed across accumulating table 202 in abutting relationship until the lead article actuates the full load switch 230. Actuation of full load switch 230 causes the carrier loading pusher 206 to push the preselected number of accumulated articles off the accumulating table and onto the carrier at the feed position. Upon full extension of the pusher, the full carrier switch 244 is actuated, which provides a signal to the carrier loading pusher to retract and a signal to a carrier drive control 276 to actuate the carrier drive 278 which advances the loaded carrier out of the feed position and an unloaded carrier to the feed position. Actuation of the carrier drive 278 also causes a carrier damper control 280 to withdraw the carrier damper 260 out of contact with the carriers. Upon removal of carrier drive, the carrier damper control permits return of the damper 260 into contact with the carriers. Upon detection of a selected number of actuations of the full carrier switch 244 by a carton loading pusher control 282, the carton loading pusher arm 100 is actuated to push the articles off the selected number of loaded carriers through the guide and into the carton 38, thereby actuating automatic carton handling control switch 270.

I claim:

1. In an automatic collating machine for organizing a flow of articles continuously fed to the machine into groups to be packaged into containers, said machine having means for accumulating said flow of articles at a first transfer location and means for carrying said articles from a position adjacent said first transfer location to a second transfer location where they may be loaded into said containers, an article transfer means at said first transfer location comprising:

means for simultaneously transferring a number of the accumulated articles to said carrying means; and means adjustable to selectively change the number transferred to an amount less than the maximum number of articles that the carrying means is capable of carrying.

2. The article transfer means of claim 1, in which said transferring means includes a pusher member for simultaneously pushing all of the articles located along the length thereof at said accumulating means onto an empty carrier, and said adjustable means includes means for varying said length, said pusher member being variable to a length less than that required to transfer said maximum number of articles.

3. The article transfer means of claim 2, in which said transferring means includes a shearing member to block the movement of accumulated articles except those located along the length of said pusher member, and said adjustable means includes means for varying the position of said shearing member in accordance with the length of the pusher member.

4. The article transfer means of claim 1, including means for guiding the articles onto the accumulating means, including a guide member, said guide member being positioned relative to the transferring means to block, during transfer, movement of accumulated articles other than the number selected for transfer.

5. The article transfer means of claim 4, including a plate spaced above said accumulating means to prevent articles thereunder from tipping on edge.

6. The article transfer means of claim 5, including means for adjusting the spacing of said tip preventing plate relative to the accumulating means to accommodate different size articles.

7. The article transfer means of claim 1, including a bridge secured to said accumulating means at one end and overlying an edge of said articles means to facilitate transfer of carriers from said accumulating means to the carrying means at said first transfer location, said bridge being formed from a resilient, flexible material to permit upward movement of said carrying means.

8. The article transfer means of claim 1 including means at said second transfer location for unloading said articles off the loaded carrying means in a direction substantially parallel to the direction in which said articles are moved onto said carrying means by said transfer means at the first transfer location.

9. In an automatic collating machine for organizing a flow of articles fed to the machine into groups to be packaged into containers having a drive mechanism and a carrier with a pair of spaced sides located intermediate a pair of spaced ends, one of which is secured to said drive mechanism, said drive mechanism adapted to move said carrier from a first transfer point to a second transfer point, means for transferring articles onto and off said carrier comprising:

means located at the first transfer point for loading a preselected number of articles onto said carrier from one of the pair of spaced sides thereof; and means located at the second transfer point for unloading the preselected number of articles off said carrier by moving them in a direction substantially parallel to the direction that they are moved when being loaded at said transfer point.

10. The article transfer means of claim 9 in which said loading means includes means for accumulating articles being moved in a direction substantially transverse to the direction in which said articles are moved when being loaded and unloaded.

11. The article transfer means of claim 9 including a plurality of said carriers and control means for causing said loading means to successively load said plurality of carriers one at a time, and wherein said unloading means includes means for simultaneously unloading a group of said plurality of carriers which are loaded.

12. In an automatic collating machine for organizing a flow of articles continuously fed to the machine into groups to be packaged into containers, a damage resistant article transfer assembly, comprising:

a flexible resilient carrier for carrying the articles to be packaged from one point to another;

means mounted for reciprocal motion for pushing articles onto said carrier; and a cam mounted to said pushing means adjacent the article engaging portion thereof for moving said carrier out of the path of motion of said pushing means in the inadvertent event of engagement therewith, thereby avoiding damage to either the pushing means, the carrier, or parts of the machine associated therewith.

13. The transfer mechanism of claim 12, including means for damping mechanical oscillation of said carrier during periods of time when it is not carrying articles from one point to another.

* * * * *